United States Patent [19]

Cobaugh et al.

[11] 4,288,139

[45] Sep. 8, 1981

[54] TRIFURCATED CARD EDGE TERMINAL

[75] Inventors: Robert F. Cobaugh, Elizabethtown; James E. Lynch, Harrisburg; Attalee S. Taylor, Palmyra, all of Pa.

[73] Assignee: AMP Incorporated, Harrisburg, Pa.

[21] Appl. No.: 18,076

[22] Filed: Mar. 6, 1979

[51] Int. Cl.[3] ..... H01R 13/62

[52] U.S. Cl. ..... 339/74 R; 339/176 MP; 339/258 P

[58] Field of Search ..... 339/74 R, 95, 75 MP, 339/176 MP, 258 R, 258 P, 17 M, 17 L

[56] References Cited

U.S. PATENT DOCUMENTS

| | | | |
|---|---|---|---|
| 2,274,398 | 2/1942 | Conrad | 339/74 R X |
| 2,742,627 | 4/1956 | Lazzery et al. | 339/193 |
| 3,040,291 | 6/1962 | Schweitzer | 339/217 S X |
| 3,069,652 | 12/1962 | Greco | 339/176 |
| 3,131,017 | 4/1964 | Mittler | 339/176 MP X |
| 3,407,379 | 10/1968 | Nakazawa | 339/176 MP |
| 3,479,634 | 11/1969 | Pritulsky | 339/17 |
| 3,649,950 | 3/1972 | Gluntz | 339/176 MP X |
| 3,693,134 | 9/1972 | Trevisiol | 339/176 MP X |
| 3,808,589 | 4/1974 | Bonhomme | 339/176 MP X |
| 3,858,153 | 12/1974 | Coller et al. | 339/258 R X |
| 4,018,495 | 4/1977 | Freitag | 339/75 MP X |
| 4,062,610 | 12/1977 | Doty et al. | 339/75 M |
| 4,077,688 | 3/1978 | Cobaugh et al. | 339/74 R |
| 4,164,725 | 8/1979 | Wiebe | 339/258 R |

FOREIGN PATENT DOCUMENTS

| | | | |
|---|---|---|---|
| 83076 | 4/1964 | France | 339/176 MP |
| 1201067 | 8/1970 | United Kingdom | 339/176 MP |

OTHER PUBLICATIONS

IBM Technical Disclosure Bulletin, vol. 13, No. 9, Feb. 1971, (p. 2612).

*Primary Examiner*—John McQuade
*Assistant Examiner*—John S. Brown
*Attorney, Agent, or Firm*—Gerald K. Kita

[57] ABSTRACT

A card edge terminal is provided with a longitudinally trifurcated portion defining a resilient beam which presses against a circuit card and provides a wiping action of its contact surface along the card. The wiping action will tend to clean away debris and contaminants.

21 Claims, 4 Drawing Figures

TRIFURCATED CARD EDGE TERMINAL

FIELD OF THE INVENTION

The present invention relates to a card edge connector and, more specifically, to an electrical terminal thereof, known as a card edge terminal. A terminal of this type is assembled into a card edge connector and resiliently engages a conductive circuit on the surface of a circuit board or circuit card which is inserted edgewise into a card receiving opening of the connector. The field of edge connectors and terminals thereof are represented by the following U.S. Pat. Nos. 3,601,782; 3,533,045; 3,977,075; 3,905,665; 4,133,592 and 4,077,688.

BACKGROUND OF THE INVENTION

Miniaturization and operating performance of electronic apparatus has benefited by semiconductor technology which allows formation of operating electronic components and also packaging of the same into miniature units known as chips. Each chip may be formed with a large number of complete circuits. Many chips are interconnected electrically to provide a desired electronic apparatus, such as a hand-held calculator or a larger, more complex computer.

Interconnection of chips is typically accomplished by mounting the chips on a planar circuit board using plated circuit paths on the board to carry electrical signals to the chips. A complex electronic machine or apparatus requires a large number of these circuit boards or cards which are inserted edgewise into card edge connectors. These connectors are provided with electrical terminals which engage circuit paths of a card. Some terminals carry electrical power into and out of the cars. Other terminals are used to carry electronic signals into and out from the card. These signals may originate from or be conducted to other cards which are inserted into other card edge connectors.

In one type of card edge connector, the terminals frictionally wipe against a card as it is being inserted into the connector. Wiping may cause undesired wear. Excessive force may be required to insert the card into the connector in opposition to the wiping friction of the terminals. In response to these problems, a second type of card edge connector has been developed. In this type connector, a moveable cam is provided for deflecting terminals toward and away from the card. In operation, the card is inserted into the connector without initially engaging the terminals. The cam is actuated to deflect the terminals, pressing the terminals against the card circuits. The terminals are disengaged from the card by cam actuation to allow removal of the card. This type of connector is called a Zero Insertion Force (ZIF) connector, since the terminals exert no force against the card during its insertion.

Since the terminals of a ZIF connector are pressed into engagement on a circuit card, there is an absence of wiping action which may be useful to scrub debris or oxides or other contaminants that otherwise prevent good electrical engagement of the terminals against the card. The present invention relates to a ZIF connector terminal which provides a wiping and debris cleaning feature merely upon being pressed against a card.

SUMMARY OF THE INVENTION

The terminal of the present invention includes a portion of its length divided into three separate contact surfaces which engage a single circuit of a card. One of the contact surfaces is provided on a separate beam or leg of the terminal which is a cantelever beam. When pressed against the card the beam will undergo resilient deflection and provide a wiping action of its contact surface along the card surface. The debris and contaminants thereby tend to be wiped away. If all three contact surfaces are relatively close together, the wiping action will be beneficial to all. Accordingly, the terminal of the present invention provides a wiping contact surface between and adjacent the other contact surfaces. To achieve the greatest amount of wiping action, the fulcrum of the resilient beam is located as far as possible from the fulcrum about which deflection of the entire terminal occurs in response to being cammed toward the card.

OBJECTS

An object of the present invention is to provide a terminal with a trifurcated portion defining three contact surfaces with one of the surfaces on a resilient beam.

Another object is to provide a resiliently deflectable card edge terminal with a longitudinally trifurcated portion defining a resilient beam which deflects independently of the remainder of the terminal.

Another object of the present invention is to provide three separate contact surfaces on a single card edge terminal with one of the contact surfaces between the other two and providing a wiping action beneficial to all three contact surfaces.

Other objects and advantages of the invention will become apparent from the following detailed description taken in conjuction with the drawings.

DRAWINGS

FIG. 1 of the drawings is an enlarged fragmentary perspective of a trifurcated portion of a card edge terminal.

DETAILED DESCRIPTION

Figure 2:
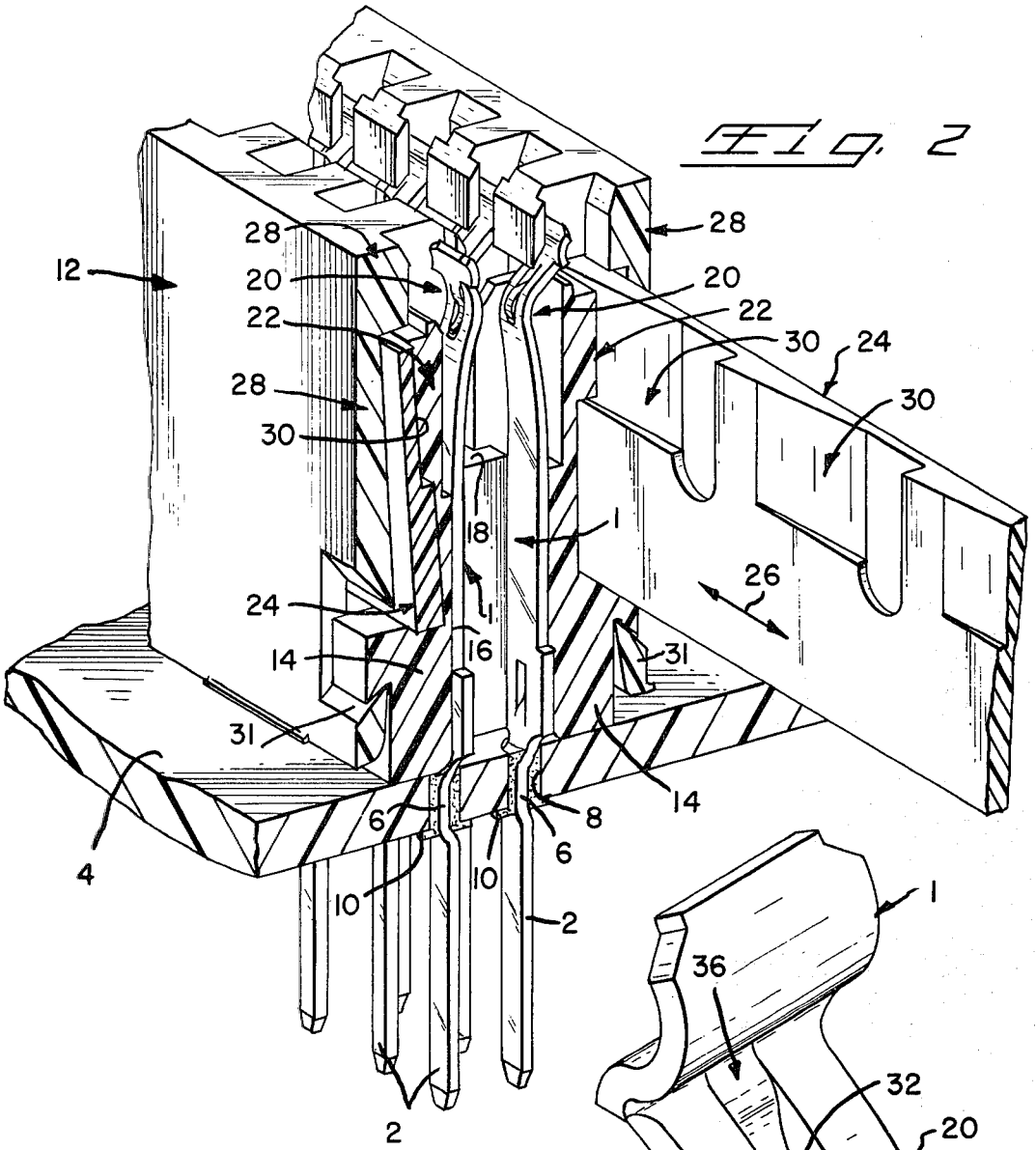
FIG. 2 is a fragmentary enlarged perspective of a ZIF card edge connector mounted on a circuit board, with parts cut away to illustrate the details of one or more complete card edge terminals of the type shown in FIG. 1.

With more particular reference to the drawings, a card edge terminal is shown generally at 1. The terminal is stamped and formed from metal strip into a one-piece, vertically elongated configuration as shown in FIG. 2. Each terminal includes a depending post portion 2 which projects outwardly from one side of a circuit board 4. Each terminal further includes a mounting section 6 which projects through the thickness of the board, and, more particularly, through an aperture 8 which has been drilled through the board thickness and through a plated circuit path 10 adhered along the inverted surface of the board 4. The aperture 8 further is filled with solder, indicated by stipling in FIG. 2, which secures the terminal to the board and electrically joins the terminal to the circuit path 10 which is used to carry electrical signals to or from the terminal.

A substantially elongated length of each terminal 1 projects vertically above the circuit board 4 for receipt in an insulative connector housing illustrated generally at 12. The terminals 1 are arranged in directly opposed pairs. The pairs of terminals are spaced apart to receive therebetween a circuit card (not shown) which is to be inserted edgewise into the connector housing 12. The housing includes an inner section generally illustrated at 14. This section directly supports the contact 1. More particularly, the housing section 14 is provided with a plurality of vertical cavities 16, each of which receive a pair of opposed terminals 1 therein. The vertical side walls of each cavity engage and support a corresponding length of terminal 1. Each cavity 16 passes through the lower end of housing section 14. Further, the cavities 16 are separated by partitions, one of which is shown at 18. The top of each partition 18 is substantially below the upper free ends 20 of the contacts 1. When a circuit card (not shown) is inserted between opposed pairs of contacts 1, the card will engage the top of partitions 18 which will limit insertion of the card into the housing 12. The housing section 14 has an upper end 22 adjacent the upper ends 20 of the contacts 1. Each side of the housing upper end 22 slidably supports a blade cam 24. Each blade 24 reciprocates horizontally back and forth in the direction of the double ended arrow 26 and in a space between the inner housing section 14 and a corresponding outer housing section illustrated generally at 28. The blade cam 24 is provided with a series of wedge shaped sections having planar inclined surfaces 30 which engage slideably against a corresponding upper end 22 of the inner housing section 14. Each outer housing section 28 is pivotally joined to the inner housing section 14 by hooked portions 31. The upper ends of each outer housing section is hooked over the upper ends 20 of the terminals.

As shown in FIG. 2, the cam blade 24 is illustrated such that the thickness of each cam section is wedged between the outer housing section 28 and the upper ends 22 of the inner housing section 14, to pivot the outer housing sections 12 toward and away from each other. As a result, each pair of elongated terminals deflect resiliently toward and away from each other, pivoting about a fulcrum defined generally where the contacts are joined to the board 4. When the free ends 20 of the contact deflect toward each other, they will press against opposite sides of a circuit card which is inserted into the connector housing 12. The contact ends 20 will deflect away from each other when the cam blades 24 are slideably traversed so that the relatively thick wedge sections are disposed between the inner housing portions 22 and the outer housing 28. When that occurs, the housing portions 28 will pivot outwardly away from each other and force the contacts 1 also to deflect away from each other. Further details of the connector are disclosed in U.S. Pat. No. 4,077,688.

Figure 1:
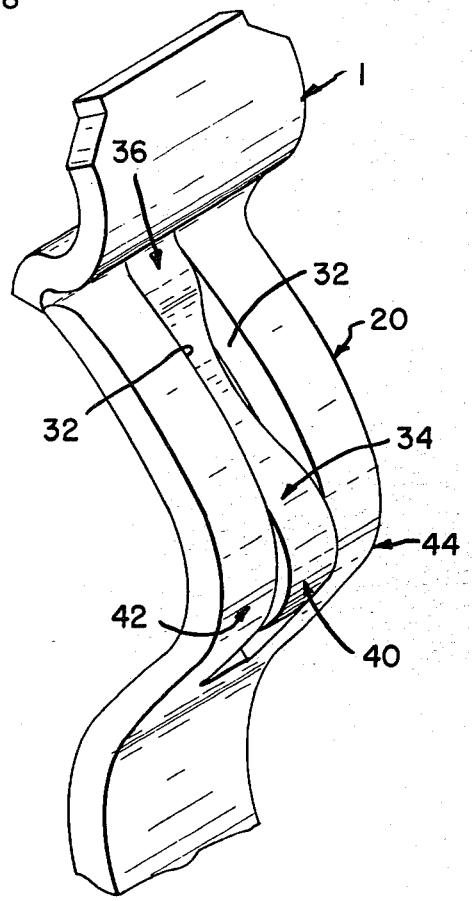

FIG. 1 illustrates an upper end 20 of one of the contacts provided with a pair of longitudinal slits 32 defining a resilient beam portion 34 joined integrally with the remainder of the terminal at 36. The opposite, free end 38 of the beam is curved and is provided with a contact surface 40 on an obverse surface thereof. The surface 40 is immediately adjacent a pair of obversely curved contact surfaces 42 and 44 on the remainder of the terminal 1. The surfaces 42 and 44 are substantially curvilinear and coplanar, while the surface 40 projects outwardly from the curvilinear plane of the surfaces 42 and 44.

Figure 4:
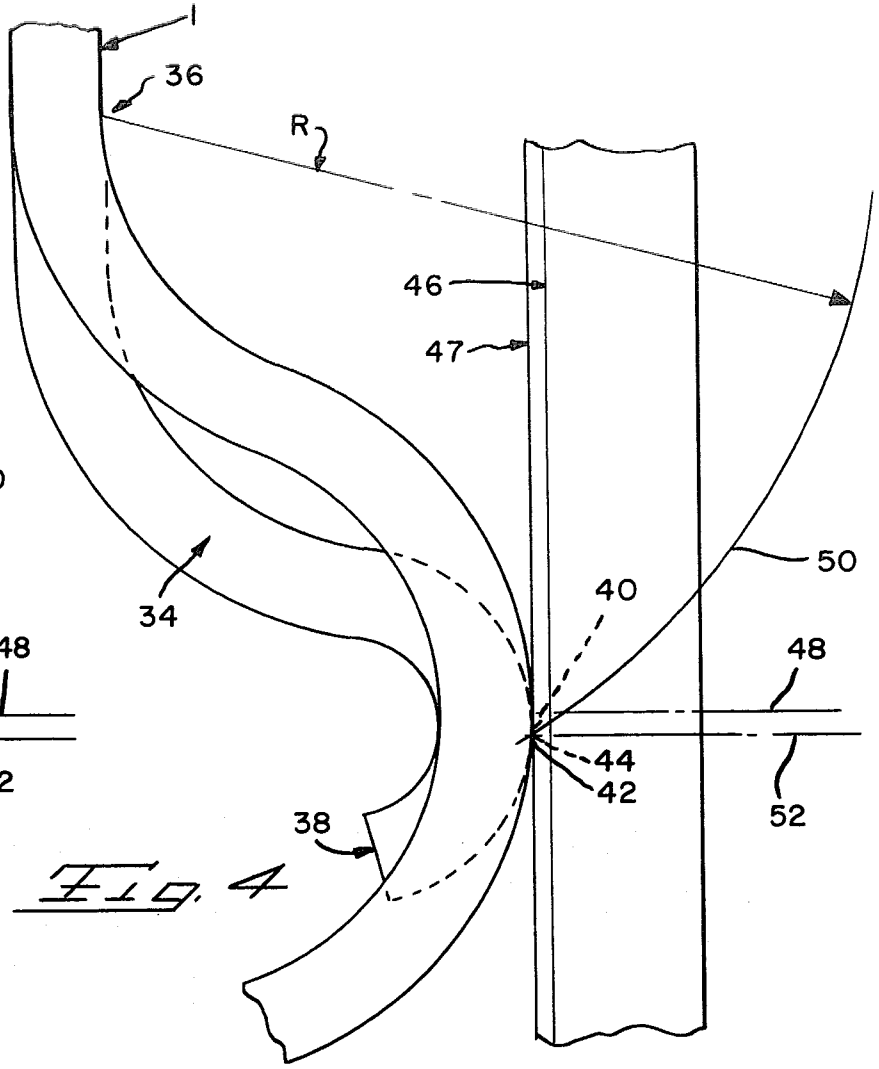
FIGS. 3 and 4 are diagramatic views illustrating the wiping action of a terminal trifurcated portion along the surface of a card of a type suitable for insertion into a card edge connector of FIG. 2.
Figure 3:
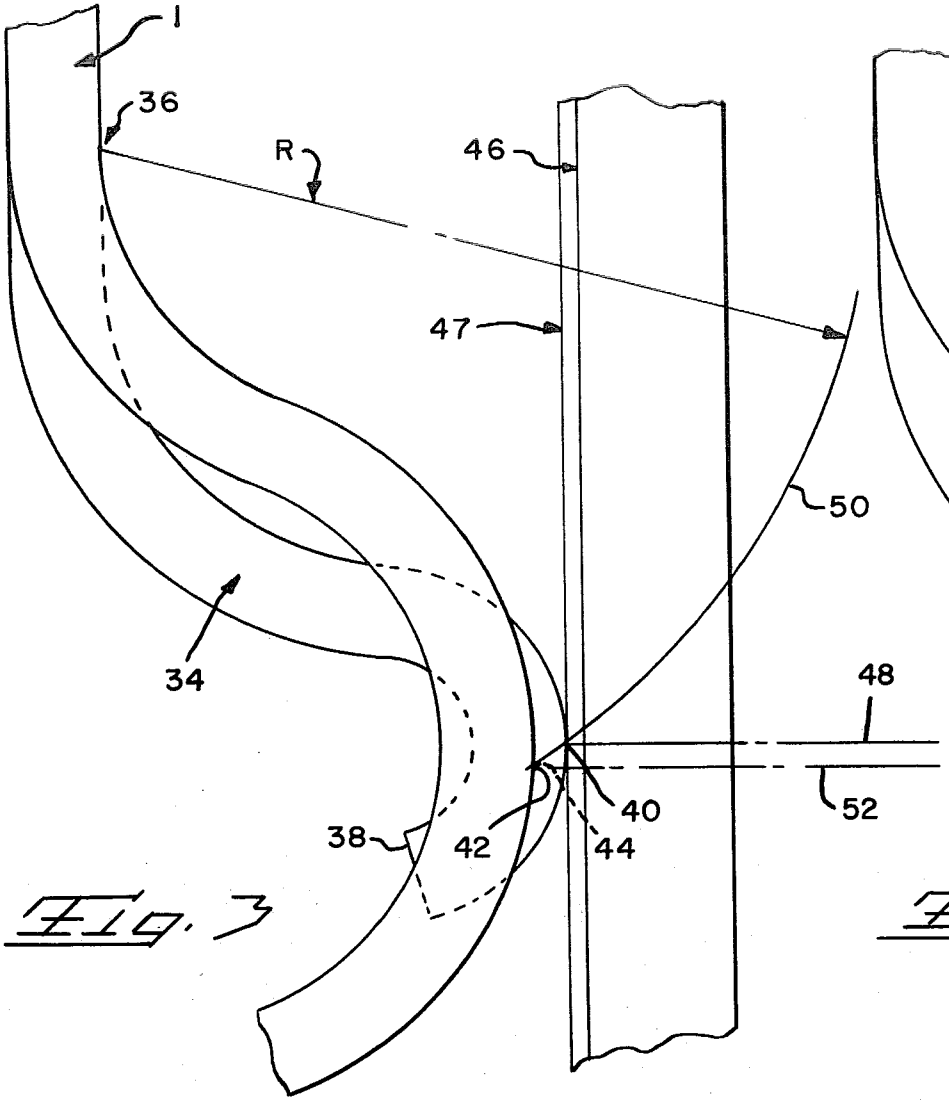

FIGS. 3 and 4 illustrate the wiping action of contact surface 40. A circuit card is illustrated generally at 46 and is viewed edgewise in the Figures. When a terminal 1 is deflected by pivoting from left to right in the Figure, for example, by the camming action of the connector described in conjunction with FIG. 2, the contact surface 40 will initially engage the surface of a circuit 47, plated onto the card 46, at a tangent indicated by a center line 48 perpendicular or normal to the tangent. Additional deflection of a terminal 1 will bring the coplanar contact surfaces 42 and 44 into pressed engagement with the surface of the circuit 47, as shown in FIG. 4. The surface of the circuit 47 is thereby tangent with both contact surfaces 42 and 44. A center line 52 is in a plane which is perpendicular or normal to the tangents of both contact surfaces 42 and 44.

When the terminal 1 is pivoted from its position shown in FIG. 3, to its position shown in FIG. 4, the contact surface 40 will pivot clockwise along an arc 50 having a radius R originating from a fulcrum defined by the junction 36 of the beam 34 with the remainder of the terminal 1. As shown in FIG. 4, the arc 50 passed through the center line 52 at the surface of the circuit 47. The contact surface 40 thereby will have been slideably displaced downwardly along the surface of the circuit 47, from the center line 48 to the center line 52. Such action produces a wiping or scrubbing of the surface of the circuit 47 tending to wipe away or otherwise remove contaminants which would interfere with good electrical contact of the surface 40 with the circuit 47. The surface 40 will be adjacent to the surfaces 42 and 44, with all three surfaces engaging the circuit along a common plane horizontal across the width of the terminal 1 and through the center line 52. Slightly further pivoting of the terminal 1 may occur to increase the pressure of the contact surfaces against the circuit. Additional wiping movement of the contact surfaces may result.

The overall width of a trifurcated portion of terminal 1 is selected to permit all three contact surfaces 40, 42, and 44 to engage the same circuit 47 in a direction across its width. The contact surface 40 will tend to wipe away particles of contaminant which might extend across the width of the circuit 47. Thereby the wiping action of contact surface 40 will benefit the electrical engagement of the adjacent contact surfaces 42 and 44.

Although a preferred embodiment of the present invention is described and disclosed in detail other embodiments and modifications thereof which would be apparant to one having ordinary skill in the art are intended to be covered by the spirit and by the scope of the claims.

What is claimed is:

1. In an elongated electrical terminal having a conductive first contact surface and a joined, resilient beam portion provided with a conductive second contact surface, with each of said contact surfaces being pivoted toward and into engagement with a conductive circuit member upon resilient pivotal deflection of said terminal in a first direction toward said circuit member, the improvement comprising:

said second contact surface being provided on a free end of said beam portion which initially projects outwardly beyond said first contact surface in said first direction, said second contact surface initially engaging said circuit member in a first position prior to engagement thereof by said first contact surface, and said beam portion being resiliently deflected by continued pivotal resilient deflection of said terminal in said first direction while said second contact surface engages said circuit member, so that said second contact surface is caused to slidably traverse along said circuit member to a second position which is on said circuit member and which is in a plane common to said first contact surface and extending directly across a width of said terminal and normal to a tangent of said first contact surface with said circuit member.

2. The structure as recited in claim 1, wherein, said second contact surface initially engages said circuit member upon resilient pivotal deflection of said terminal without deflection of said beam portion.

3. The structure as recited in claim 1, wherein, said beam portion is joined integrally with said terminal.

4. The structure as recited in claim 1, wherein, said terminal is pivotal about a first fulcrum portion, and said first end of said beam portion is joined integrally with said terminal at a second fulcrum portion.

5. The structure as recited in claim 4, wherein, said beam portion projects from said second fulcrum portion, and said free end is closer to said first fulcrum portion than is said second fulcrum portion.

6. In an elongated electrical terminal having a conductive first contact surface facing outwardly of said terminal and caused to engage against a stationary, conductive circuit conductor, upon resilient pivotal deflection of said terminal toward said circuit conductor, the improvement comprising:

a resilient beam portion joined to and initially projecting outwardly of said terminal in the same direction as said first contact surface, and being constructed to engage said circuit conductor at a first position thereon prior to engagement thereof by said first contact surface upon initial resilient pivotal deflection of said terminal toward said circuit conductor, said beam portion being constructed to undergo resilient deflection while engaged against said circuit conductor, upon continued pivotal deflection of said terminal toward said circuit conductor, first, to slidably traverse along said circuit conductor prior to said first conductive surface engaging said circuit conductor, and then, to engage said circuit conductor in a position which is in a plane common to said contact surface and extending directly across a width of said terminal and normal to a tangent of said first contact surface and said circuit conductor.

7. The structure as recited in claim 6, wherein, said beam portion is integral with the remainder of said terminal and is constructed with a free end portion projecting outwardly of said terminal in the same direction as said first contact surface to engage, and slidably traverse along, said circuit conductor upon pivotal deflection of said terminal toward said circuit conductor.

8. The structure as recited in claim 9, wherein, said free end portion is provided with a conductive second contact surface initially projecting outwardly beyond said first contact surface in said first direction, and initially spaced from said first contact surface in a second direction along the length of said terminal;

said second contact surface engaging said circuit member upon resilient deflection of said terminal about said fulcrum portion in said first direction without deflection of said beam portion; and upon additional resilient deflection of said terminal to cause engagement of said first contact surface with said circuit member, said second contact surface then slidably traversing along said circuit member, while engaged therewith, toward said first contact surface in reverse of each said firs direction and said second direction.

9. The structure as recited in claim 6, wherein, said beam portion initially is caused to engage said circuit member upon said deflection of said terminal without resilient deflection of said beam portion.

10. An elongated electrical terminal for resilient deflection toward a conductive circuit member, to establish electrical engagement therewith, comprising:

a conductive first surface on said terminal for pressed engagement against said circuit member upon resilient deflection of said terminal toward said circuit member, a beam portion joined to the remainder of said terminal and initially projecting outwardly beyond the plane of said first surface in a direction toward said circuit member, said beam portion engaging said circuit member prior to engagement thereof by said first surface when said terminal is deflected resiliently toward said circuit member, said beam portion being constructed for resilient deflection while engaged against said circuit member so that continued resilient deflection of said terminal toward said circuit member will resiliently deflect said beam portion, and cause slidable traverse of said beam portion along said circuit member to a position on said circuit member which is coplanar with and adjacent to said first surface while the same is engaged against said circuit member, a plane extending directly across said common width of said terminal and normal to a tangent of said first surface and said circuit member.

11. The structure as recited in claim 10, wherein, said first surface is provided on an obversely curved portion of said terminal, said beam portion is defined by a pair of longitudinal slits through said obversely curved portion, and said beam portion is formed with a free end initially bent outwardly of said curved portion, and outwardly beyond the plane of said first surface to engage said circuit member prior to engagement thereof by said first surface.

12. The structure as recited in claim 11, wherein, said free end is curved to provide an obverse surface for engaging tangentially said circuit member.

13. An elongated electrical terminal for resilient deflection toward a conductive circuit member to establish electrical engagement therewith, comprising:

a conductive first contact surface on said terminal for pressed engagement against said circuit member upon resilient deflection of said terminal toward said circuit member, a resilient beam portion joined to said terminal and having a wiping contact surface projecting outwardly of the plane of said terminal and the plane of said first contact surface in a direction toward said circuit member, said wiping contact surface engaging against said circuit member upon resilient deflection of said terminal toward said circuit member, and said beam portion being constructed for resilient deflection while said wiping contact surface remains engaged against said circuit member, so that continued resilient deflection of said terminal toward said circuit member will resiliently deflect said beam portion, and slidably traverse said wiping contact surface along said circuit member to a position on said circuit member in a plane which is common to both said first contact surface and said wiping contact surface and which extends directly across a width of said terminal and normal to a tangent of said first contact surface with said circuit member.

14. The structure as recited in claim 13, wherein, said beam portion is joined integrally with said terminal and includes a free end on which said wiping contact surface is provided and which surface initially projects outwardly of the plane of said first contact surface.

15. The structure as recited in claim 13, wherein, said terminal is constructed with a fulcrum portion, said beam portion includes a first end integral with the remainder of said terminal and a free end projecting nearer said fulcrum portion than said first end, and projecting outwardly of the plane of said terminal, and said wiping contact surface is provided on said free end.

16. An elongated resilient electrical terminal, comprising:

a mounting portion adapted to be secured to a support, a bowed contact portion spaced from said mounting portion along the length of said terminal and having an obverse curved first contact surface adapted to engage an electrical circuit conductor upon resilient deflection of said terminal toward said circuit conductor, a resilient beam portion having a first end portion joined with the remainder of said terminal, and a second, free end portion projecting outwardly beyond the remainder of said first contact portion, in the same direction as said first contact surface, to engage said circuit conductor prior to engagement thereof by said first contact surface, said beam portion being constructed to deflect resiliently and slidably wipe said free end portion along said circuit conductor to a position which is on said circuit conductor and which is in a plane common to sadi first contact surface and extending directly across a width of said terminal and normal to a tangent of said first contact surface and said circuit conductor, in response to resilient deflection of said terminal toward said circuit member.

17. The structure as recited in claim 16, wherein, said free end of said beam portion and said bowed contact portion of said terminal are nearer said mounting portion of said terminal than is said first end portion of said beam portion.

18. The structure as recited in claim 16, wherein, said beam portion includes opposite sides extending from said first end of said beam to said free end thereof, and which sides are divided from said bowed contact portion by a pair of spaced apart slits through said bowed contact portion.

19. An electrical card edge connector, comprising:

an insulating housing having an interior card receiving cavity and an open side communicating with said cavity, one or more rows of resilient electrical terminals in said housing and having respective mounting portions secured to said housing, said terminals in first positions engaging against circuit conductors on a circuit card, the edge of which has been inserted into said open side and positioned in said cavity, and means for resiliently deflecting said terminals from said first positions to second positions away from said cavity to disengage said terminal from said circuit conductors, each said terminal including a bowed contact portion spaced from said mounting portion along the length of said terminal and having an obverse curved first contact surface adapted to engage an electrical circuit conductor upon resilient deflection of said terminal from a respective said second position to a respective said first position, said contact portion being divided longitudinally to provide a resilient beam portion having a first end portion joined with the remainder of said terminal, and a second, free end portion projecting outwardly beyond the remainder of said contact portion, in the same direction as said first contact surface, to engage a respective said circuit conductor prior to engagement thereof by said curved contact surface, said beam portion being constructed to deflect resiliently and slidably wipe said free end portion along said circuit conductor to a position which is on said circuit conductor and which is in a plane common to said first contact surface and extending directly across a width of said terminal and normal to a tangent of said first contact surface and said circuit conductor, in response to resilient deflection of said terminal toward said circuit member.

20. The structure as recited in claim 19, wherein, said free end of said beam portion is nearer said mounting portion of said terminal than is said first end portion of said beam portion.

21. The structure as recited in claim 19, wherein, said contact portion is longitudinally divided by a pair of longitudinal, spaced apart slits which define opposite sides of said beam portion from said first end portion to said free end portion, and said beam portion is bent to project the free end thereof outwardly beyond the remainder of said contact portion, in the same direction as said first contact surface.

* * * * *